US005249537A

United States Patent [19]

Sakakibara

[11] Patent Number: 5,249,537

[45] Date of Patent: Oct. 5, 1993

[54] EMBROIDERY FRAME

[75] Inventor: Hisato Sakakibara, Inazawa, Japan

[73] Assignee: Kabushikikaisha Barudan, Aichi, Japan

[21] Appl. No.: 908,456

[22] Filed: Jul. 6, 1992

[30] Foreign Application Priority Data

Nov. 6, 1991 [JP] Japan ..... 3-318452

[51] Int. Cl.[5] ..... D05C 7/00; D05C 9/04

[52] U.S. Cl. ..... 112/103; 112/121.15

[58] Field of Search ..... 112/103, 121.11, 121.12, 112/121.15, 102

[56] References Cited

U.S. PATENT DOCUMENTS 4,386,573 6/1983 Davidson et al. ..... 112/103

4,993,333 2/1991 Moore, III ..... 112/103

OTHER PUBLICATIONS

Japanese Publication No. 63-2474, and translation, Jan. 1988.

Japanese Application No. 1-11752, and translation, Apr. 1989.

*Primary Examiner*—Clifford D. Crowder

*Assistant Examiner*—Paul C. Lewis

*Attorney, Agent, or Firm*—Pollock, Vande Sande & Priddy

[57] ABSTRACT

A cloth spreading frame is joined to a driving frame so that the cloth spreading frame projects horizontally therefrom. This cloth spreading frame is supported at the free end portion thereof on a leg which can be moved horizontally therewith. Accordingly, even when the cloth spreading frame is formed to a large size so that a cloth having a large region to be embroidered can be set thereon, and, moreover, even when the cloth spreading frame is formed with material of a large diameter and a large thickness so that the cloth spreading frame can follow up a movement of a driving frame without being vibrated laterally, the lowering of the free end portion of the cloth spreading frame can be prevented, so that the embroidering of a cloth can be done properly.

6 Claims, 6 Drawing Sheets

EMBROIDERY FRAME

BACKGROUND OF THE INVENTION

1. Field of the Invention

This invention relates to an embroidery frame used to retain in tension region to be embroidered of a cloth on which embroidery is to be made by an embroidering machine.

2. Description of the Prior Art

The embroidery frame of this kind includes the following. A driving frame is adapted to be moved horizontally by a driving means in the embroidering machine. A cloth spreading frame is joined to the driving frame so that the cloth spreading frame projects horizontally from the driving frame. The cloth spreading frame is provided with an embroidery hole used to expose a region to be embroidered of a cloth thereto.

When this conventional embroidery frame is used, a small article, such as a sock can be embroidered without any trouble with the sock held on a cloth spreading frame so that a region to be embroidered thereof is positioned in the embroidery hole in the cloth spreading frame. However, in order to make embroidery on a wide region, such as the whole surface of the back of, for example, a sports jacket, it is necessary that a cloth spreading frame be formed to a larger size accordingly. In order that a larger-sized cloth spreading frame can follow up a horizontal movement of the driving frame without being vibrated laterally, it is necessary that the cloth spreading frame be made of a material of a large diameter and a material of a large thickness. If a cloth spreading frame is formed with such materials, the weight thereof increases. If embroidery is made on a cloth by using such a cloth spreading frame, a free end portion of the cloth spreading frame lowers due to its own weight. If the free end portion of the cloth spreading frame thus lowers, the lower surface of the region to be embroidered of a cloth rubs against a bed of the embroidering machine, so that the cloth wears out. In some cases, the region being embroidered of the cloth becomes unable to be moved in accordance with the movement of the driving frame due to the resistance occurring in the cloth rubbing against the bed of the embroidering machine, to cause a deformed embroidered pattern to be produced. These are the problems encountered in a conventional embroidery frame.

In order to prevent the free end portion of the cloth spreading frame from lowering as mentioned above, the cloth spreading frame may be formed with materials of a further larger diameter and a further larger thickness which permit the resultant cloth spreading frame to withstand its own weight. However, if the cloth spreading frame is formed in this manner, the weight thereof becomes very large. A heavy cloth spreading frame constitutes an unbalanced load with respect to the driving frame. This prevents a regular driving mechanism from providing a high-speed horizontal movement of the driving frame. A large and heavy cloth spreading frame has such problems.

SUMMARY OF THE INVENTION

The present invention has been developed with a view to solving the problems (technical problems) of the above-described prior art embroidery frame.

An object of the present invention is to provide an embroidery frame in which a free end portion of a cloth spreading frame is supported on a leg, whereby, even when the cloth spreading frame is formed to a large size and, moreover, with materials of a large diameter and a large thickness so that the cloth spreading frame can follow up a horizontal movement of a driving frame without being vibrated laterally, the lowering of the free end portion of the cloth spreading frame can be prevented, so that the embroidering on a cloth can be done properly.

In the embroidery frame according to the present invention, embroidery hole-carrying cloth spreading frame is joined to a driving frame, which is adapted to be moved horizontally by driving means in the embroidering machine, so as to project horizontally therefrom, a leg for supporting the cloth spreading frame being provided on the side of the free end portion of the cloth spreading frame so that the leg is moved horizontally with the cloth spreading frame.

A cloth to be embroidered is held in tension on the cloth spreading frame so that the region to be embroidered of the cloth is exposed to the embroidery hole. When the driving frame is then moved horizontally, the cloth spreading frame is also moved horizontally therewith, and the region to be embroidered of the cloth in the embroidery hole is moved horizontally. Embroidery is made on the region while it is moved in this manner. In this embroidery frame, the cloth spreading frame is supported at its free end portion on the leg, so that the lowering of the same portion is prevented.

The present invention having the above-described construction has the following effects. When the cloth spreading frame is formed to a larger size so as to make embroidery on a region of a large area of a cloth, and, moreover, with materials of a large diameter and a large thickness so as to enable the cloth spreading frame to follow up a horizontal movement of the driving frame without being vibrated laterally thereby, the weight of the cloth spreading frame increases. However, the present invention has advantageous features that the cloth spreading frame is supported at its free end portion on the leg, whereby the lowering of the free end portion can be prevented even when the weight of the cloth spreading frame is thus increased. Owing to this advantageous structure, the abrasion of the lower surface of the region to be embroidered of a cloth against the bed of an embroidering machine and the deformation of embroidered patterns, which are encountered in a conventional embroidering machine, can be prevented. Accordingly, proper embroidery can be made on a cloth.

While the cloth spreading frame is moved horizontally, load on the free end portion thereof is supported on the leg mentioned above, though the cloth spreading frame is joined in a projecting state to the driving frame. Therefore, the occurrence of an unbalanced load imparted to a prior art driving frame can be prevented. This enables the driving frame to be moved lightly.

DESCRIPTION OF THE PREFERRED EMBODIMENTS

Figure 1:
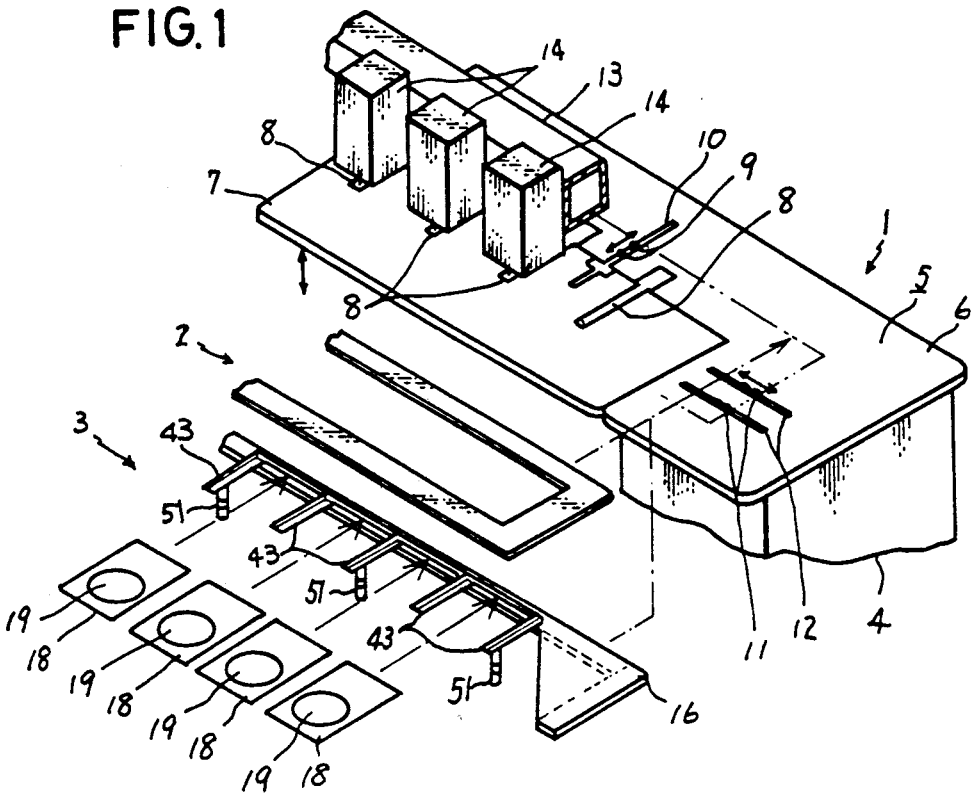
FIG. 1 is a perspective view of an embroidering machine.

The embodiments of the present invention will now be described with reference to the drawings. Referring to FIG. 1, a reference numeral 1 denotes an embroidering machine, 2 a regular embroidery frame used when embroidery is made on a sheet type cloth or flat goods such as open shirts in the embroidering machine 1, and 3 an embroidery frame used when embroidery is made on a cylindrical cloth or three dimensional goods. This embroidering machine 1 has ordinary construction except that a part of a table is made vertically movable. A reference numeral 4 denotes a table, 5 a top plate or a table top consisting of a fixed portion 6 and a vertically movable portion 7, 8 a plurality of beds or cylinder arms, for example, eight (four beds only are shown in the drawing) beds attached to the fixed portion 6 in parallel with one another, 9 driving means for moving the embroidery frame in the longitudinal direction, and 11 driving means for moving the embroidery frame in the lateral direction, these driving means 9, 11 being exposed to the upper side of the top plate 5 through slits 10, 12 provided in the top plate and comprised of rollers. The driving means 9 are fastened to a driving plate 9*a* (refer to FIG. 3A) adapted to be moved by a driving unit provided in the table 4. The driving means 11 are formed in the same manner, though the construction thereof is not shown. A reference numeral 13 denotes a support frame provided in a horizontally-laid state above the table 4. Heads 14 are fixed to this support frame 13 so that the head 14 are positioned above the beds 8.

The embroidery frame 2 is a known frame, which is provided in the lower surface thereof with recesses in which the driving means 9, 11 are to be fitted.

The embroidery frame 3 consists of a driving frame 16, and cloth spreading frames 18 capable of being attached to and detached from the driving frame 16. The driving frame 16 has recesses, in which the driving means 9, 11 are to be fitted, just as in the embroidery frame 2. The cloth spreading frames 18 are provided so that the number of the cloth spreading frames corresponds to that of the beds 8. A reference numeral 19 denotes embroidery holes formed in the cloth spreading frames 18.

Figure 3A:
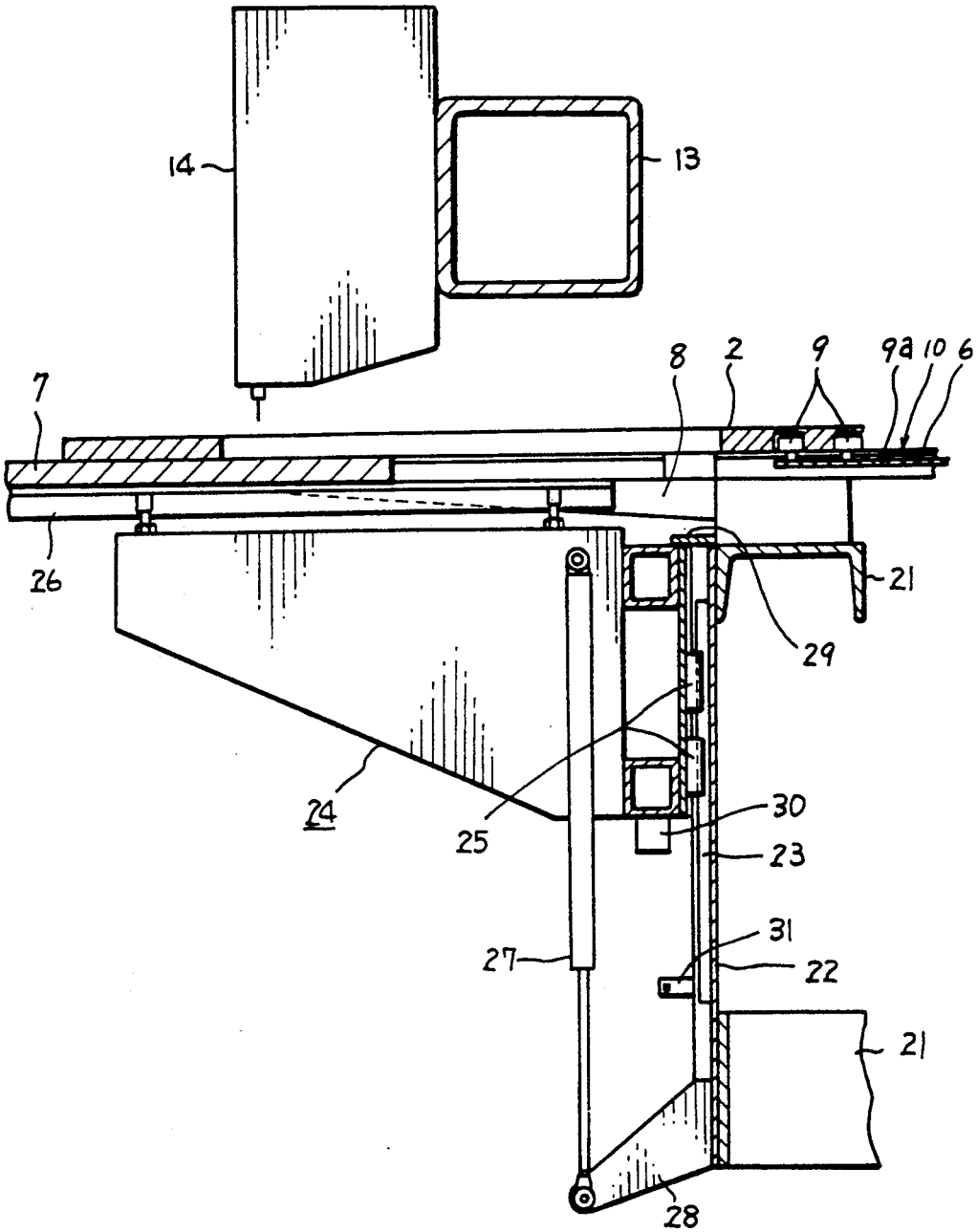
FIG. 3A is a sectional view, which is taken along the line A—A in FIG. 5, of a movable portion in a raised position of a table.
Figure 3B:
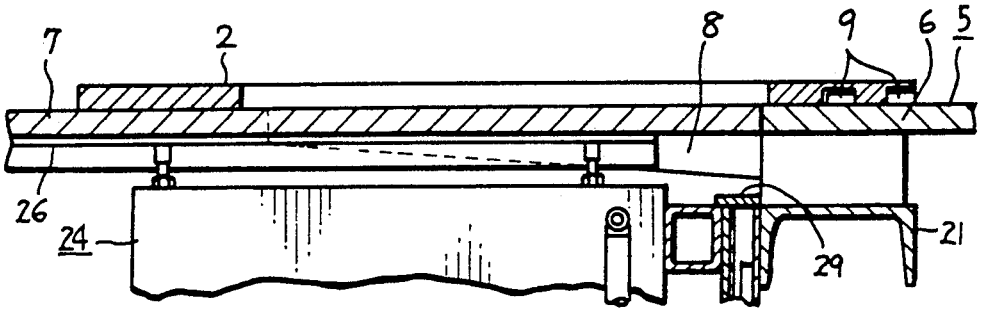
FIG. 3B is a sectional view, which is taken along the line B—B in FIG. 5, of the movable portion in the same condition.
Figure 4A:
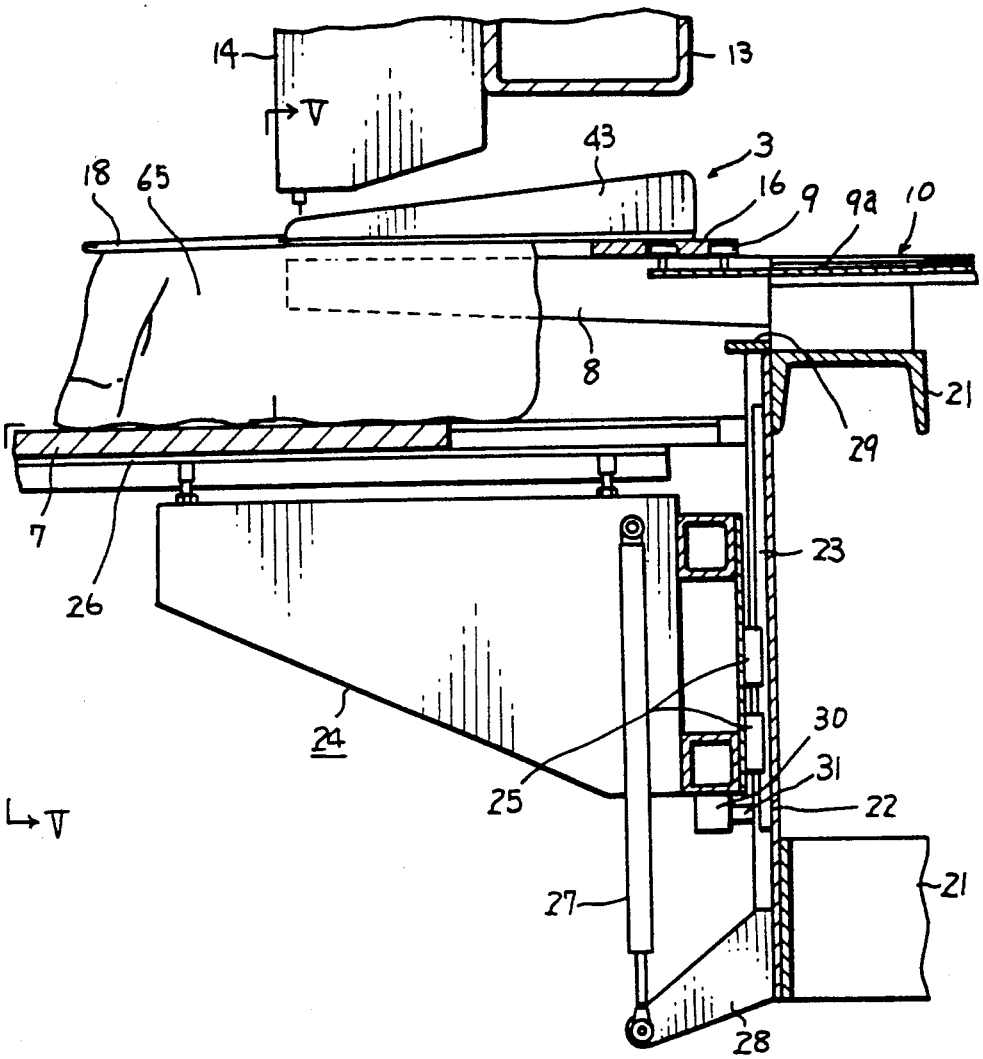
FIG. 4A is a sectional view, which is taken along the line A—A in FIG. 5, of the movable portion in a lowered position of the table.
Figure 5:
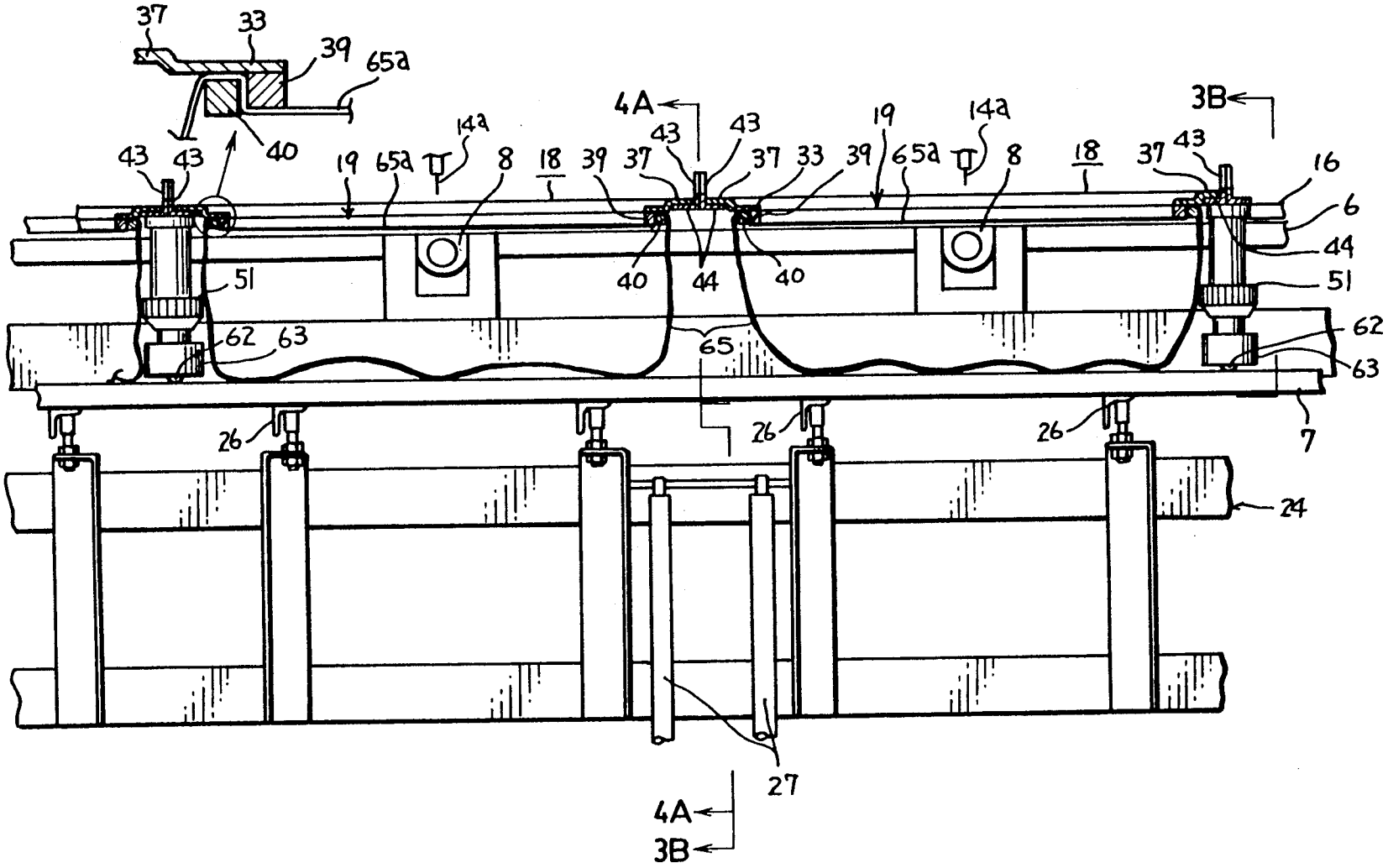
FIG. 5 is a sectional view taken along the line V—V in FIG. 4A.

A structure for vertically moving the movable portion 7 in the embroidering machine 1 will now be described on the basis of what are shown in FIGS. 3 and 5. A reference numeral 21 denotes base frames of the table 4, 22 a leg sheathing plate, and 23 a vertically extending rail fixed to the base frames 21 via the leg sheathing plate 22. On the other hand a reference numeral 24 denotes a support frame having on its rear surface slide members 25 vertically movable along the rail 23, and 26 a table support member of the support frame 24, which consists, for example, of an angle material to which the movable portion 7 is fixed. A reference numeral 27 denotes a spring member for lifting the movable portion 7, which spring member is adapted to apply an upward urging force to the support frame 24. For example, a gas cylinder is used as the spring member 27, which is connected at one end to the support frame 24 and at the other end to the base frame 21 via a bracket 28. A reference numeral 29 denotes a stopper fixed to the base frame 21 and used to stop an upward movement of the support frame 24 in a position in which the upper surfaces of the movable and fixed portions 7, 6 become flush with each other as shown in FIG. 3B, 30 a main body of a lowered state holding unit, which is fixed to the lower portion of the support frame 24, and 31 a locking member of the lowered state holding unit, which is fixed to the base frame 21. These parts are adapted to hold the lowered state of the movable portion 7 with the locking member 31 engaging the main body 30 when the movable portion 7 of the top plate is moved down. This lowered state holding unit consists, for example, of a part called a lock. The movable portion 7 is normally held in a position, in which the upper surfaces of the movable and fixed portions 7, 6 become flush with each other, by the urging force of the spring member 27 and the positioning force of the stepper 29. When the movable portion 7 is pressed down, for example, manually against the urging force of the spring member 27, the main body 30 of the lowered state holding unit and locking member 31 are engaged with each other, so that the movable portion 7 is held in a lowered position as shown in FIG. 4A.

Figure 2:
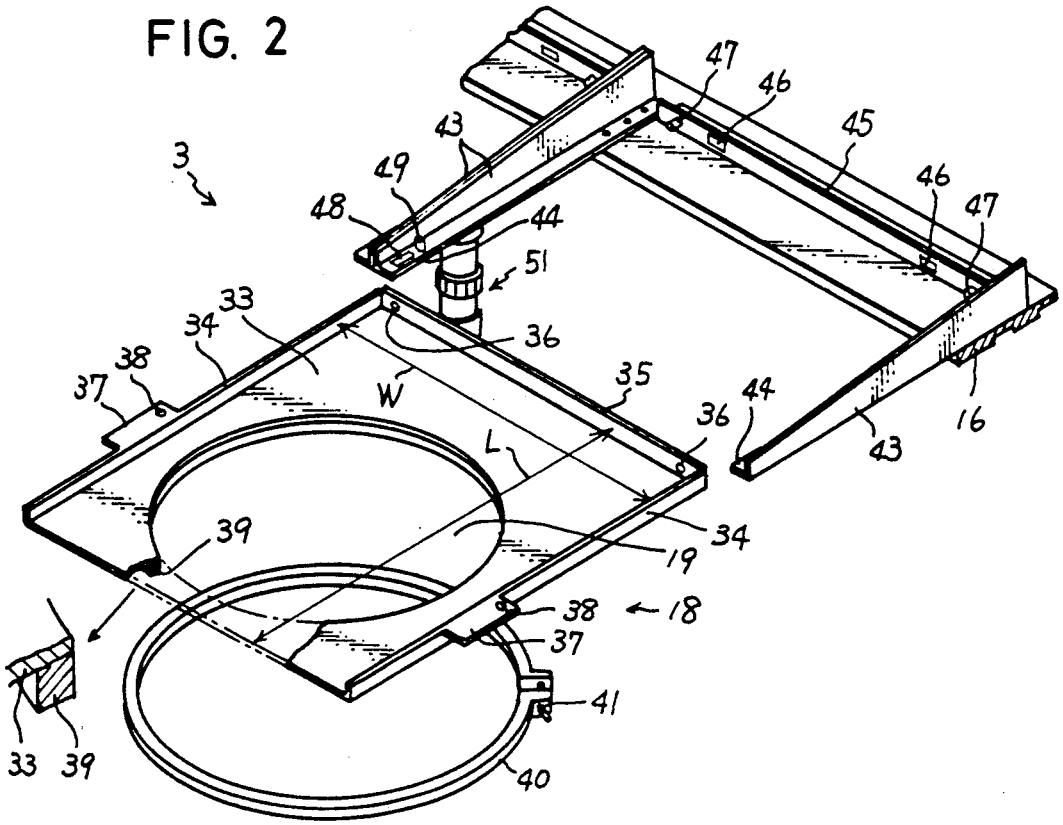
FIG. 2 is an exploded view in perspective of an embroidery frame.

The embroidery frame 3 will now be described with reference to FIG. 2. First, a cloth spreading frame 18 will be described. A reference numeral 33 denotes a base plate having ribs 34, 35 at the left, right and rear end portions thereof and formed so that it has a sufficiently high strength even when it consists of a comparatively thin material. This base plate 33 is formed by pressing, for example, a steel plate. The width W of the base plate 33 is, for example, 460 mm, and the length L thereof 570 mm. The rib 35 constitutes a contact member to be engaged with a receiving member which will be described later. The rib 35 is provided at the end portions thereof with positioning through holes 36. A reference numeral 37 denotes connecting members provided integrally with the ribs 34 and having positioning through holes 38. The embroidery hole 19 referred to above is formed in this base plate 33 (to a diameter of, for example, 420 mm). An inner frame 39 is attached to the lower surface of the base plate 33. A reference numeral 40 demotes a known outer frame. The outer frame 40 is cut off at one portion of its circularly extending body. The resultant end portions of the outer frame are formed so as to be tightened together with a tightening screw 41. The tightening of these end portions enables a cloth to be embroidered to be set firm between the outer circumferential surface of the outer frame 39. and the inner circumferential surface of the outer frame 40.

A structure for connecting the cloth spreading frame 18 to the driving frame 16 will now be described. A reference numeral 43 denotes arms fixed at their base end portions to the driving frame 16, formed to an L-shaped cross section and having a length of about 400 mm. A horizontal portion at the free end section of each arm 43 constitutes a support portion 44 for supporting the relative connecting portion 37 referred to above. A reference numeral 45 denotes a receiving member fixed to the driving frame 16 and provided thereon with magnets 46 for connecting the cloth spreading frame 18 to the driving frame 16, and pins 47 for positioning the cloth spreading frame 18 with respect to the driving frame 16. These pins 47 are provided in the positions corresponding to the through holes 36 mentioned above. A reference numeral 48 denotes a connecting magnet provided on the support portion 44 and similar to the magnets 46, and 49 a positioning pin similar to the pins 47 and provided in the position corresponding to the relative through hole 38.

Figure 6:
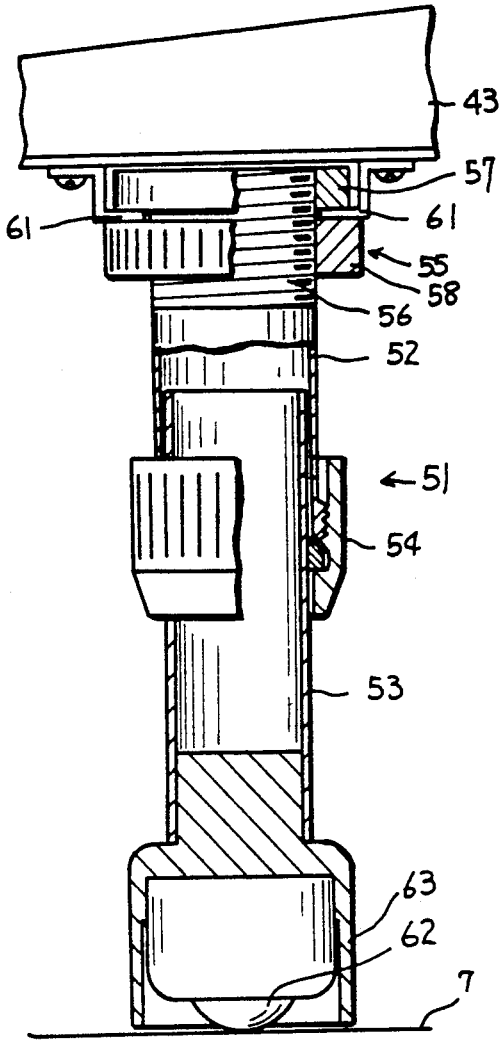
FIG. 6 is a partially cutaway view in side elevation of an arm and a leg fastened thereto.

A reference numeral 51 denotes a leg for supporting the cloth spreading frame 18 at the free end portion thereof and fastened detachably to the lower surfaces of adjacent arms 43. The portions of adjacent arms 43 to which the leg 51 is fastened are, for example, about 280 mm away from the base end portions of the arms 43. These leg-fastening portions of the arms 43 may be closer to the free end portions thereof. The leg 51 will now be described in detail with reference to FIGS. 6 and 7. As shown in FIG. 6, the leg 51 is formed with an upper cylindrical member 52 and a lower cylindrical member 53 inserted withdrawably into the upper cylindrical member 52 so that the length of the leg 51 can be increased and decreased. The lower member 53 can be fixed to the upper member 52 by means of a tightener 54 provided on the lower end portion of the upper member 52. A reference numeral 55 denotes a connecting structure provided on the upper end portion of the upper member 52 and formed as follows. A reference numeral 56 denotes a threaded portion formed at the upper section of the upper member 52, 57 a flange type stopper member fixed to the upper end portion of the upper member 52, and 58 a tightening member engaged with the threaded portion 56. Reference numerals 61, 61 denote stopper members fixed to the lower surfaces of adjacent arms 43 so that the stopper members 61, 61 are spaced in an opposed state by a distance G which corresponds to the diameter of the threaded portion 56. A reference numeral 62 denotes a roller provided at the lower end portion of the lower member 53 so that the roller 62 can be moved horizontally and smoothly on the movable portion 7 of the top plate, and 63 a skirt provided so as to prevent a cloth from entering the lower side of the roller 62. The legs 51 formed as described above are used in the positions shown in FIG. 1, in such a manner that each of the cloth spreading frames 18 can be supported at either the left side or the right side thereof. Such legs 51 may be fastened to all the arms 43 so as to support each cloth spreading frame 18 at both the left and right sides thereof.

A cloth embroidering operation carried out by using the embroidering machine 1 will now be described. In the case where embroidery is made on an ordinary sheet type cloth and a flat cloth, the embroidery frame 2 is used. This embroidering operation is as generally known. Namely, a cloth to be embroidered is set on the embroidery frame 2. The resultant embroidery frame 2 is joined to the driving means 9, 11 with the movable portion 7 in the lifted condition as shown in FIGS. 3A and 3B. Embroidery is then made on the cloth in a usual manner by operating the embroidering machine 1.

Figure 4B:
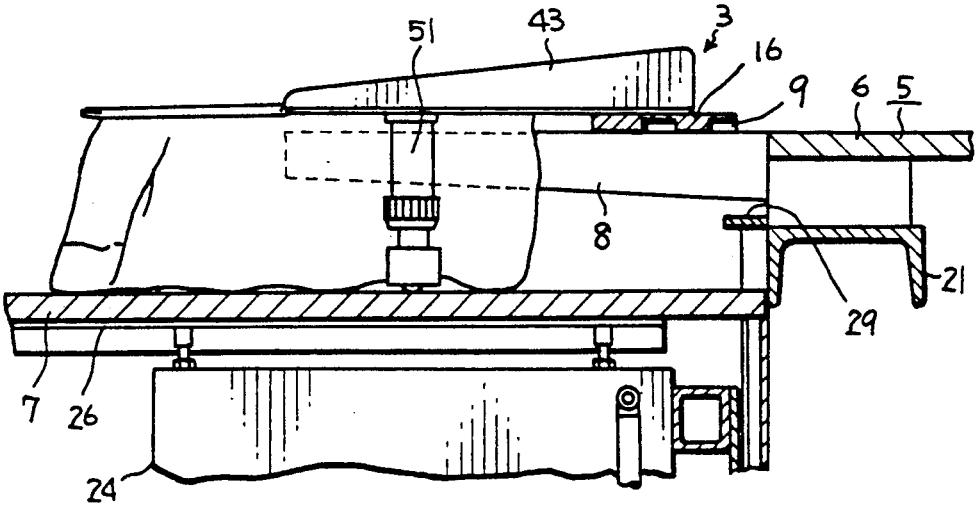
FIG. 4B is a sectional view, which is taken along the line B—B in FIG. 5, of the movable portion in the same condition.
Figure 7:
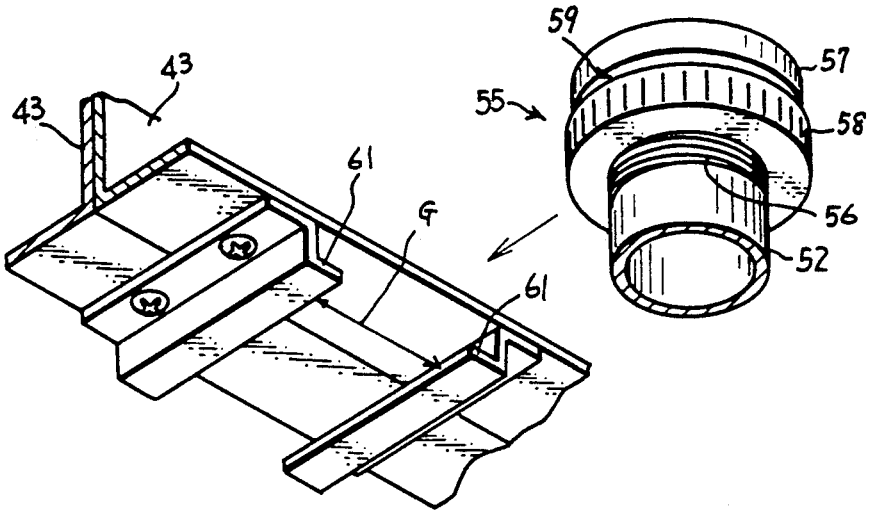
FIG. 7 is a partial view showing the relation between the arm and the leg.

In the case where embroidery is made on a cylindrical cloth, for example, the back of a sports jacket, the embroidery frame 3 is used. In this case, the movable portion 7 of the top plate 5 is held in the lowered condition as shown in FIGS. 4A and 4B. First, in a place away from the embroidering machine 1, a cloth is set on the cloth spreading frame 18 so that a region (back) to be embroidered thereof is positioned in the hole 19. This operation is identical with a cloth setting operation using a conventional cloth spreading frame. In such an operation, the relation between the inner and outer frame 39, 40 in the cloth spreading frame 18 is as shown in a partial enlarged illustration in FIG. 5. In FIG. 5, cloths are designated by a reference numeral 65, and regions to be embroidered by a reference numeral 65*a*. In the meantime, the driving frame 16 is joined to the driving means 9, 11 on the embroidering machine 1, and legs 51 are fastened to the arms 43. In order to fasten a leg 51 to arms 43, the leg 51 in the condition shown in FIG. 7 is first placed under the arms 43 so as to insert the stopper members 61 into a clearance 59 between the stopper member 57 and tightening member 58 of the leg 51. The tightening member 58 is then tightened to obtain a leg-fastened condition shown in FIG. 6.

The cloth spreading frame 18 on which the cloth 65 has been set is then connected to the driving frame 16 in the following manner. First, the cloth spreading frame 18 is inclined so that the front portion (lower left portion in FIGS. 1 and 2) thereof becomes higher with the rear portion (the portion on the side of the contact member 35) thereof becoming lower. The contact member 35 is then applied to the receiving member 45 so that the pins 47 are fitted into the through holes 36. The front portion of the cloth spreading frame 18 is then lowered, and the pins 49 are fitted into the through holes 38. Consequently, the magnets 46 attract the contact member 35, and the magnets 48 the connecting members 37. As a result, the cloth spreading frame 18 is joined reliably to the driving frame 16. Owing to these steps taken, the leg 51 supports the cloth spreading frame 18 at the free end portion thereof.

The embroidering machine 1 is then operated in a usual manner with the cloth spreading frame 18 in this condition. Consequently, the driving frame 16 is moved horizontally by the driving means 9, 11, and the cloth spreading frame 18 is moved horizontally with the driving frame 16. Accordingly, the region to be embroidered, which is positioned in the hole 19, of the cloth is moved horizontally. Embroidery is then made on this region of the cloth in accordance with the operations of an embroidery needle 14*a* provided on the head 14 and the rotating hook on the bed 8. During this time, the leg 51 is moved horizontally with the cloth spreading frame 18 owing to the roller 62 lightly rolling on the movable portion 7 of the top plate, thus preventing the free end portion of the cloth spreading frame 18 from lowering.

A different mode of embodiment will now be described. The arm 43 may be provided fixedly on the base plate 33 of the cloth spreading frame 18 with the base end portion of the arm 43 detachably joined to the driving frame 16. The leg 51 may be fastened directly to the free end, or a portion close to the free end, of the cloth spreading frame 18. A structure for connecting the cloth spreading frame 18 in a horizontally projecting state to the driving frame 16 may be formed as follows. Namely, a fork-like holder is attached to the driving frame so as to project horizontally therefrom. The connecting members provided at the left and right edges of the cloth spreading frame are then joined to the front end portions of the holder.

Figure 8:
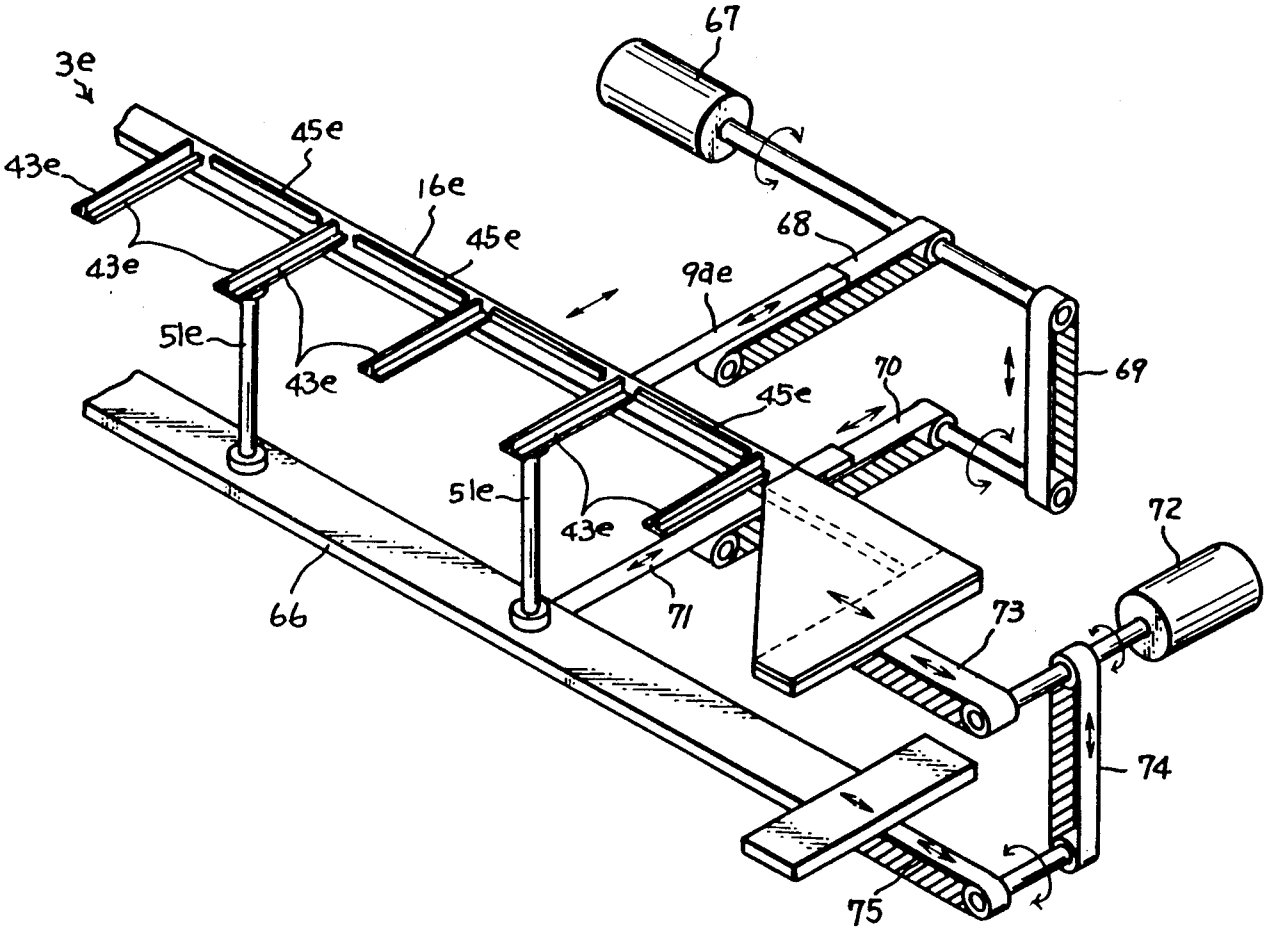
FIG. 8 is a construction diagram of a different embodiment.

Another embodiment of the present invention will now be described with reference to FIG. 8. In this embodiment, the lower ends of legs 51*e* for supporting the cloth spreading frames are supported on a support frame 66 which is moved horizontally with a driving frame 16*e*. Referring to the drawing, the support frame 66 is provided below the cloth spreading frames, and, in this embodiment, below the arms 43*e* for holding the cloth spreading frames, in such a manner that the support frame 66 can be moved horizontally. A timing belt 68 is connected to a pulse motor 67, which is adapted to move the driving frame 16*e* forward and backward, in such a manner that the timing belt 68 can be turned in accordance with an operation of the pulse motor 67. A driving means 9*ae* similar to that mentioned above is attached to this timing belt 68. Another timing belt 70 is connected via a timing belt 69 to the pulse motor 67 so that the timing belt 70 can be turned in accordance with an operation of the pulse motor 67. A driving means 71 is attached to the timing belt 70. The relation between the driving means 71 and support frame 66 is the same as that between the driving means 9*ae* and driving frame 16*e*. The movements of the driving means 71 in the directions of a dual arrow are transmitted to the support frame 66, and the support frame 66 can be moved freely in the horizontal direction which is at right angles to this dual arrow, with respect to the driving means 71. A reference numeral 72 denotes a pulse motor for use in moving the driving frame 16*e* in the lateral direction, and a timing belt 73 is joined to this motor. Driving means identical with the driving means 11 shown in FIG. 1 are fixed to this timing belt 73. Another timing belt 75 is connected to the pulse motor 72 via a timing belt 74. The support frame 66 is connected to the timing belt 75 so as to have relation identical with that between the timing belt 73 and driving frame 16*e*.

In the embodiment having such construction, the driving frame 16*e* and support frame 66 are moved together in the horizontal direction, and the legs 51*e* and cloth spreading frames together horizontally. Therefore, the driving frame 16*e* and the cloth spreading frames mounted thereto are moved together in the horizontal direction. The timing belts 70, 75 may be operated by other pulse motors adapted to be turned synchronously with the pulse motors 67, 72, respectively. The parts of this embodiment which are considered functionally identical with or equivalent to any parts of the embodiment of the previously-mentioned drawings are designated by the same reference numerals as are used in the latter drawings with the letter "e" added thereto, whereby duplicated descriptions of the parts are omitted.

What is claimed is:

1. An embroidery frame for an embroidery machine comprising:

a driving frame having an arm which moves in a horizontal plane along an upper surface of a bed;

driving means for moving said driving frame horizontally;

a cloth-spreading frame connected to said driving frame, projecting horizontally therefrom, having an embroidery hole over which cloth is disposed;

an upstanding leg connected to said arm of said driving frame; and, a support frame having an upper surface below said cloth spreading frame for supporting a free end of said upstanding leg for movement with movement of said cloth-spreading frame.

2. An embroidery frame according to claim 1, wherein said leg is provided at the lower end portion thereof with a roller for rolling on said upper surface of said support frame.

3. An embroidery frame according to claim 1, wherein said cloth spreading frame is detachably connected to said driving frame.

4. An embroidery frame according to claim 1, wherein said driving frame is detachably connected to said driving means in said embroidering machine.

5. An embroidery frame for an embroidery machine comprising:

a driving frame having a base portion supported on a movable portion of a top plate of an embroidery machine, said driving frame comprising a pair of arms above said top plate, extending outwardly therefrom parallel to said top plate;

a cloth-spreading frame having a base plate which is received in said pair of arms and has an embroidery hole which is positioned by said arms over said top plate; and, a leg connected to support an overhanging end of one of said arms on said movable portion of said top plate, said leg being freely movable over said top plate movable portion when said driving frame is horizontally positioned over said movable portion.

6. The embroidery frame for an embroidery machine according to claim 5, wherein said embroidery frame further comprises:

first and second ribs on first and second lateral sides of said base plate, and a third rib on a remaining said of said base plate; and, first and second connecting members connected to said first and second ribs, which support said base plate to said first and second arms.

* * * * *